US007383623B2

(12) United States Patent
Kozik

(10) Patent No.: US 7,383,623 B2
(45) Date of Patent: Jun. 10, 2008

(54) ASSEMBLY AND METHOD FOR VENT INSTALLATION

(76) Inventor: Pawel R. Kozik, 2919 N. Harlem Ave., #509, Chicago, IL (US) 60707

( * ) Notice: Subject to any disclaimer, the term of this patent is extended or adjusted under 35 U.S.C. 154(b) by 29 days.

(21) Appl. No.: 11/413,746

(22) Filed: Apr. 28, 2006

(65) Prior Publication Data

US 2007/0251093 A1 Nov. 1, 2007

(51) Int. Cl.

| | |
|---|---|
| ***B25B 27/14*** | (2006.01) |
| ***B23P 11/02*** | (2006.01) |
| ***B23Q 3/00*** | (2006.01) |
| *B23P 17/00* | (2006.01) |

(52) U.S. Cl. ..... 29/281.1; 29/451; 29/464

(58) Field of Classification Search ..... 29/281.1, 29/451, 464, 432, 513

See application file for complete search history.

(56) References Cited

U.S. PATENT DOCUMENTS

| | | | | |
|---|---|---|---|---|
| 4,042,262 | A * | 8/1977 | Mooney et al. | 285/98 |
| 4,260,005 | A * | 4/1981 | Stencel | 411/3 |
| 4,569,110 | A * | 2/1986 | Goettel | 29/890.11 |
| 4,878,285 | A * | 11/1989 | Carstensen | 29/451 |
| 5,207,602 | A * | 5/1993 | McMills et al. | 439/836 |
| 5,213,460 | A * | 5/1993 | Sadri et al. | 411/43 |
| 5,218,277 | A * | 6/1993 | Pattison et al. | 318/135 |
| 5,584,129 | A | 12/1996 | Williamson | |
| 5,609,195 | A * | 3/1997 | Stricklin et al. | 141/346 |
| 5,609,501 | A * | 3/1997 | McMills et al. | 439/578 |
| 5,702,215 | A * | 12/1997 | Li | 411/21 |
| 6,122,812 | A * | 9/2000 | Thoms | 29/283.5 |
| 6,195,910 | B1 | 3/2001 | Robineau | |
| 6,199,440 | B1 * | 3/2001 | Greubel et al. | 74/89.23 |
| 6,443,496 | B2 * | 9/2002 | Campau | 285/81 |
| 6,584,702 | B2 | 7/2003 | Irey | |

* cited by examiner

*Primary Examiner*—Joseph J. Hail, III
*Assistant Examiner*—Alvin J Grant
(74) *Attorney, Agent, or Firm*—Mark E. Wiemelt

(57) ABSTRACT

A vent connection assembly for use in the installation of a vent on an exterior wall of a building and interconnection with a conduit in the interior of the building, including a first plate having a diameter smaller than the diameter of the vent, a second plate having a diameter smaller than the diameter of the vent, a deformable member defining a periphery, the deformable member having a diameter smaller than the diameter of the vent and being positioned between the first plate and the second plate, and a mechanism for drawing said first plate and said second plate together after said deformable member has been inserted into the vent, thereby deforming said deformable member and extending said deformable member radially to frictionally engage the vent. A method of installing a vent on an exterior wall of a building and connecting the vent to conduit within the interior of a building using the vent connection assembly.

17 Claims, 12 Drawing Sheets

ASSEMBLY AND METHOD FOR VENT INSTALLATION

BACKGROUND OF THE INVENTION

During installation of a vent on an exterior wall of a building and connection of the vent to conduit within the interior of a building, the process typically requires two or more persons and a ladder, particularly if the vent is being installed on an upper floor. In addition, the installation process can be unduly time-consuming, particularly if attempted by one person. As a result, it is desirable that an installation device and method eliminate the need for more than one person to install the vent. It is also desirable that the installation method and device eliminate the need for the use of a ladder and the attendant safety risks. Further, it is desirable that the installation be as simple as possible with few operational steps.

There are numerous known devices and methods for installation of a vent on the exterior of a building and connection of the vent to conduit within the interior of a building. In most of those known methods, the use of multiple people, multiple steps and/or a ladder is required for the installation because the vent is positioned on the exterior of the building and the conduit is positioned in the interior of the building. These deficiencies result in a time consuming and awkward installation process, sometimes resulting in a damaged or destroyed vent. In addition, the deficiencies can result in injury to the installer.

SUMMARY OF THE INVENTION

The present invention provides an installation assembly and method that provides quick and efficient installation of a vent on the exterior of a building and connection of the vent to conduit within the interior of a building. A single worker is able to install the vent without the need for assistance from another individual or a ladder. The installation assembly reduces damage to or destruction of the vent during installation. The installation assembly also reduces the risk of injury to the installer during installation.

A broad aspect of the invention includes a vent connection assembly for use in the installation of a vent on an exterior wall of a building and interconnection with a conduit in the interior of the building, including a first plate having a diameter smaller than the diameter of the vent, a second plate having a diameter smaller than the diameter of the vent, a deformable member defining a periphery, the deformable member having a diameter smaller than the diameter of the vent and being positioned between the first plate and the second plate, and a mechanism for drawing said first plate and said second plate together after said deformable member has been inserted into the vent, thereby deforming the deformable member and extending the deformable member radially to frictionally engage the vent.

Another aspect of the invention includes a method of installing a vent on an exterior wall of a building and connecting the vent to conduit within the interior of a building comprises the following steps providing the vent connection assembly; inserting the deformable member into the vent, activating the mechanism to draw the first plate and second plate together until pressure exerted by the first plate and the second plate causes the periphery of the deformable member to expand and frictionally engage the vent, extending a rope-like member through an opening in the exterior wall, attaching the rope-like member to the vent connection assembly, retracting the rope-like member through the opening in the exterior wall until the vent connection assembly and an interior portion of the vent extend at least partially through the opening in the exterior wall, securing the vent connection assembly and interior portion of the vent, detaching the rope-like member from the vent connection assembly, and interconnecting the vent to conduit within the interior of the building.

In this respect, before explaining the preferred embodiment and the alternative embodiments of the present invention in detail, it is to be understood that the present invention is not limited in its application to the details of construction and to the arrangements of the components and methods set forth in the following description or illustrated in the drawings. The present invention is capable of other embodiments and of being practiced and carried out in various ways. Also, it is to be understood that the phraseology and terminology employed herein are for the purpose of description and should not be regarded as limiting.

It is, therefore, an object of the present invention to provide a vent connector assembly to facilitate installation of a vent on an exterior wall of a building and connection of the vent to conduit within the interior of a building which is easy to use.

It is also an object of the present invention to provide a vent connector assembly to facilitate installation of a vent on an exterior wall of a building and connection of the vent to conduit within the interior of a building which is easy to manufacture.

It is further an object of the present invention to provide a vent connector assembly to facilitate installation of a vent on an exterior wall of a building and connection of the vent to conduit within the interior of a building which eliminates the need for multiple persons during the installation process.

It is further an object of the present invention to provide a vent connector assembly to facilitate installation of a vent on an exterior wall of a building and connection of the vent to conduit within the interior of a building which reduces damage to the vent during installation.

It is further an object of the present invention to provide a vent connector assembly to facilitate installation of a vent on an exterior wall of a building and connection of the vent to conduit within the interior of a building which reduces damage to the vent during installation.

It is yet another object of the present invention to provide a vent connector assembly to facilitate installation of a vent on an exterior wall of a building and connection of the vent to conduit within the interior of a building which reduces injury to the installer during installation.

It is still a further object of the present invention to provide a vent connector assembly to facilitate installation of a vent on an exterior wall of a building and connection of the vent to conduit within the interior of a building which eliminates the need to use a ladder during installation.

These and other objects of the present invention will become apparent in view of the present specification, claims and drawings.

There has thus been outlined, rather broadly, the more important features of the invention in order that the detailed description thereof that follows may be better understood, and in order that the present contribution to the art may be better appreciated. There are, of course, additional features of the invention that will be described hereinafter and that will form the subject matter of the invention.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the present invention in any way.

These together with other objects of the present invention, along with the various features of novelty which characterize the present invention, are pointed out with particularity in the claims annexed to and forming a part of this disclosure. For a better understanding of the present invention, its operating advantages and the specific objects attained by its uses, reference should be had to the accompanying drawings and descriptive matter in which there is illustrated a preferred embodiment of the present invention and alternative embodiments.

DRAWINGS

Figure 14:
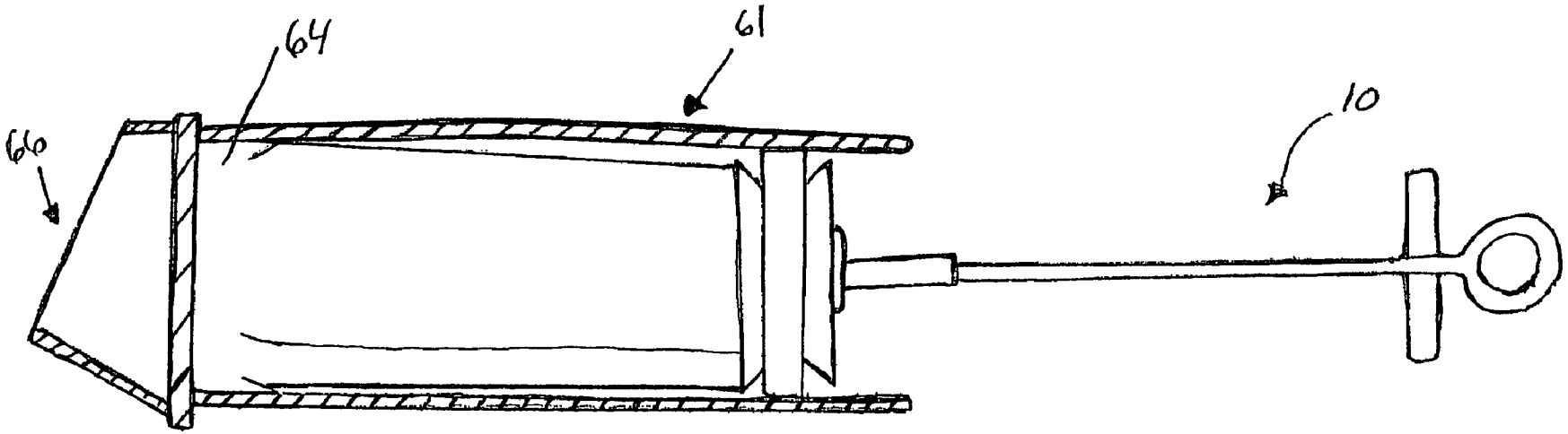

FIG. 14 is a side elevational view of the vent connection assembly constructed in accordance with the preferred embodiment of the present invention inserted into the hollow interior portion of the vent, illustrating the periphery of the deformable member expanded to frictionally engage the interior surface of the hollow interior portion of the vent and the elongated fingers biased against the interior surface of the hollow interior portion of the vent.

Figure 15:
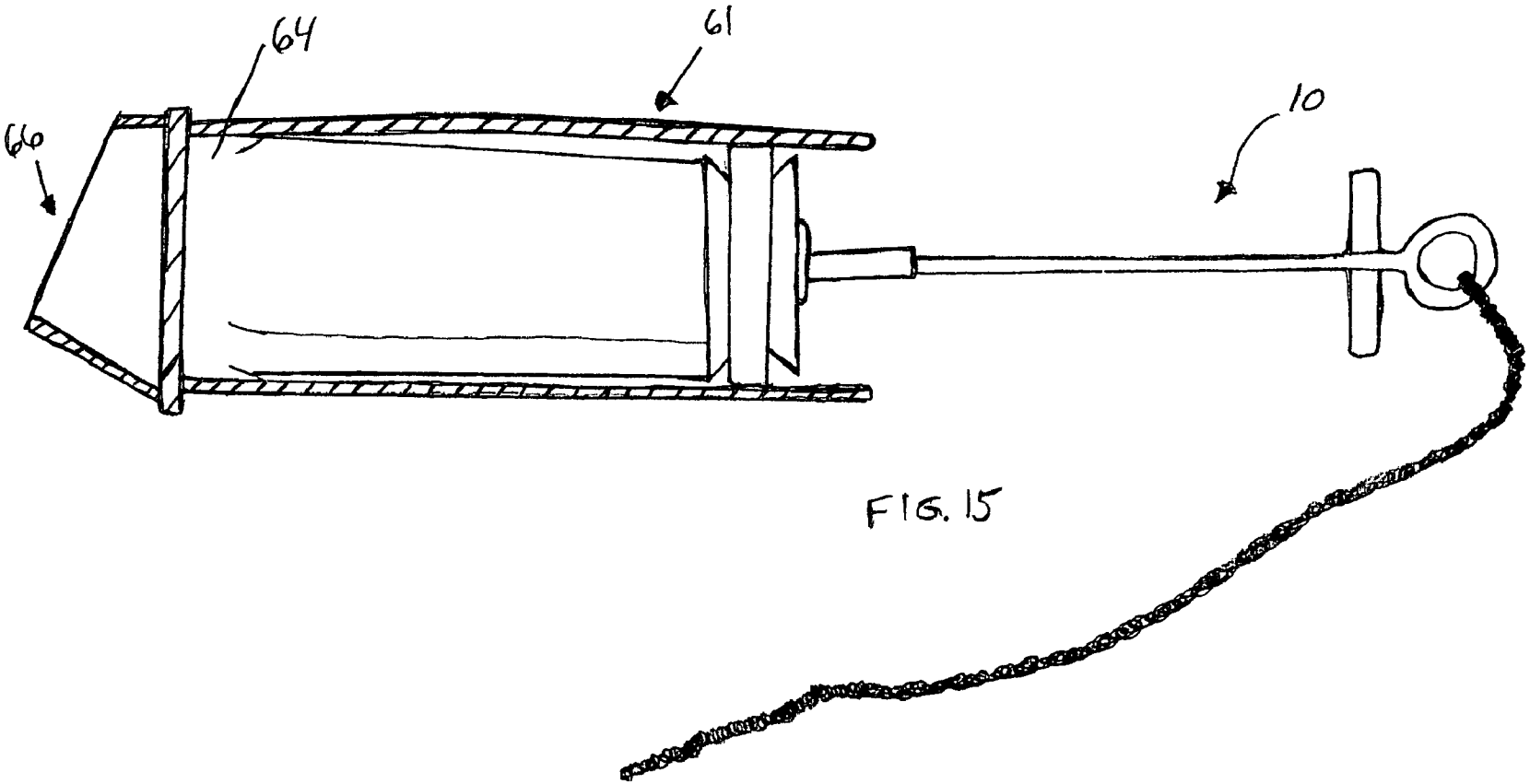

FIG. 15 is a side elevational view of the vent connection assembly constructed in accordance with the preferred embodiment of the present invention inserted into the hollow interior portion of the vent, showing a rope-like member attached to the first threaded bolt.

Figure 16:
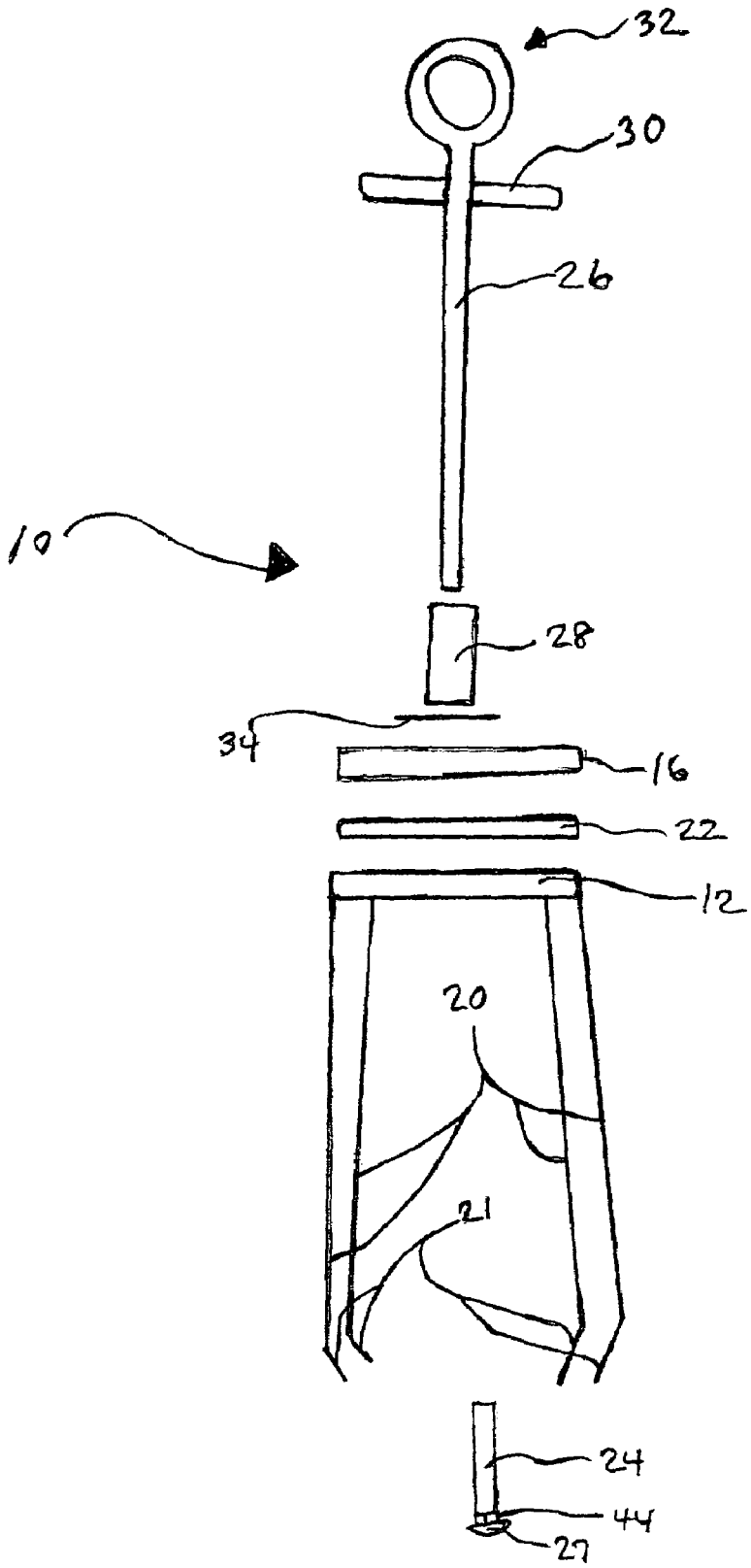

FIG. 16 is a side elevational view of the vent connection assembly constructed in accordance with an alternate embodiment of the present invention.

DETAILED DESCRIPTION OF THE PREFERRED EMBODIMENT AND ALTERNATIVE EMBODIMENTS OF THE INVENTION

While the invention may be susceptible to embodiments in different forms, there will be described in detail the preferred embodiment and alternative embodiments with the understanding that the present disclosure is to be considered an exemplification of the principles of the invention, and is not intended to limit the claims to that which is described herein.

Figure 1:
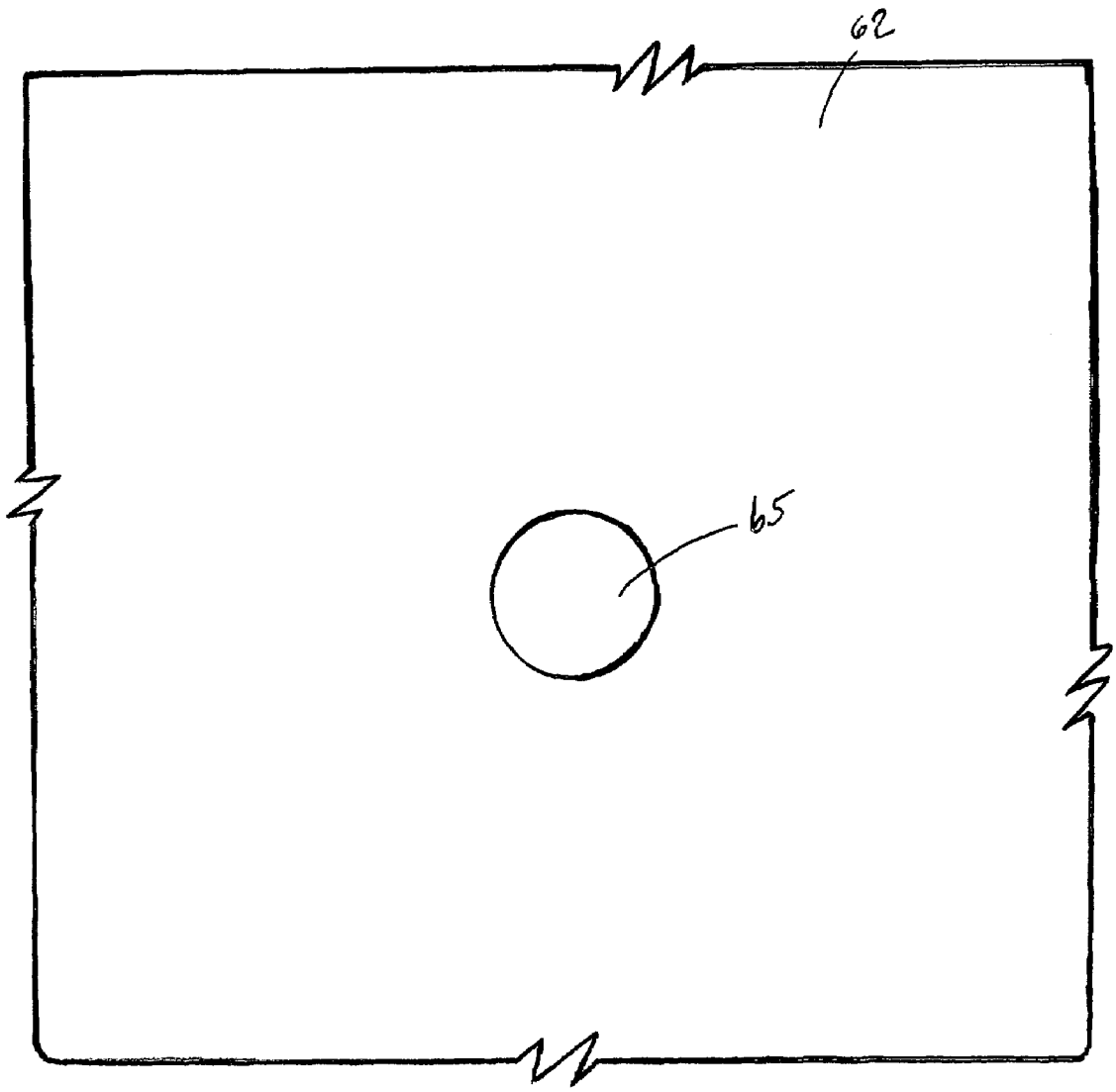
FIG. 1 is an elevational view of an exterior wall of a building having a vent hole therein.

Referring now to the drawings, FIG. 1 depicts an exterior wall 62 of a building having a vent hole 65.

Figure 2:
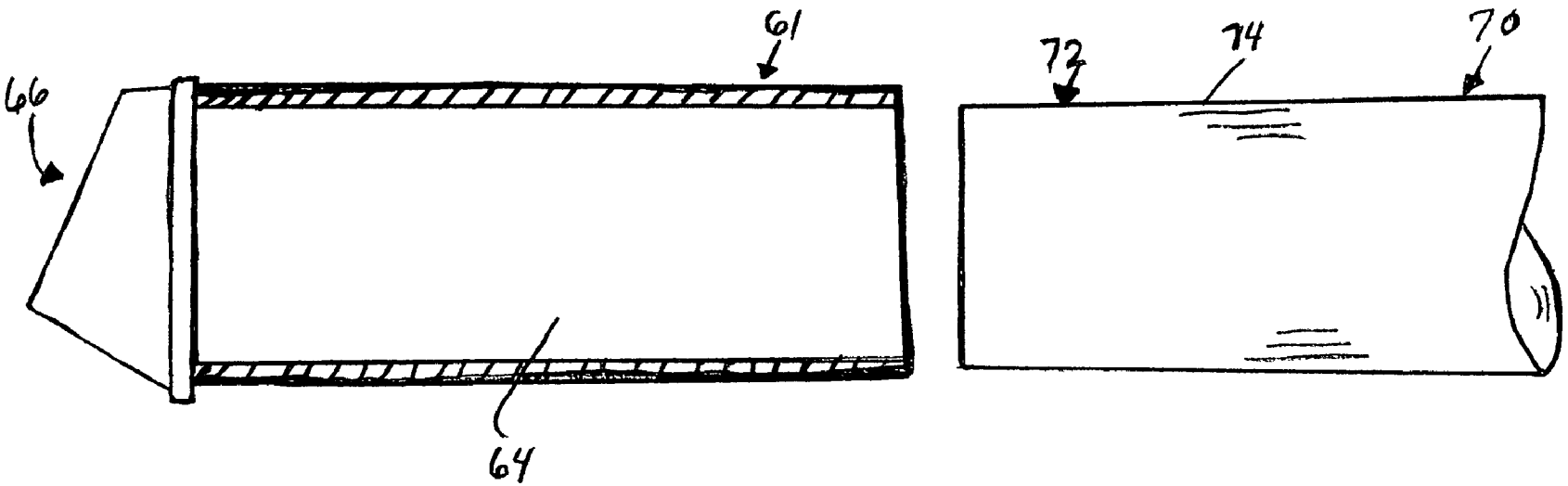
FIG. 2 is a side elevational view of a typical dryer exhaust vent and an associated conduit.
Figure 3:
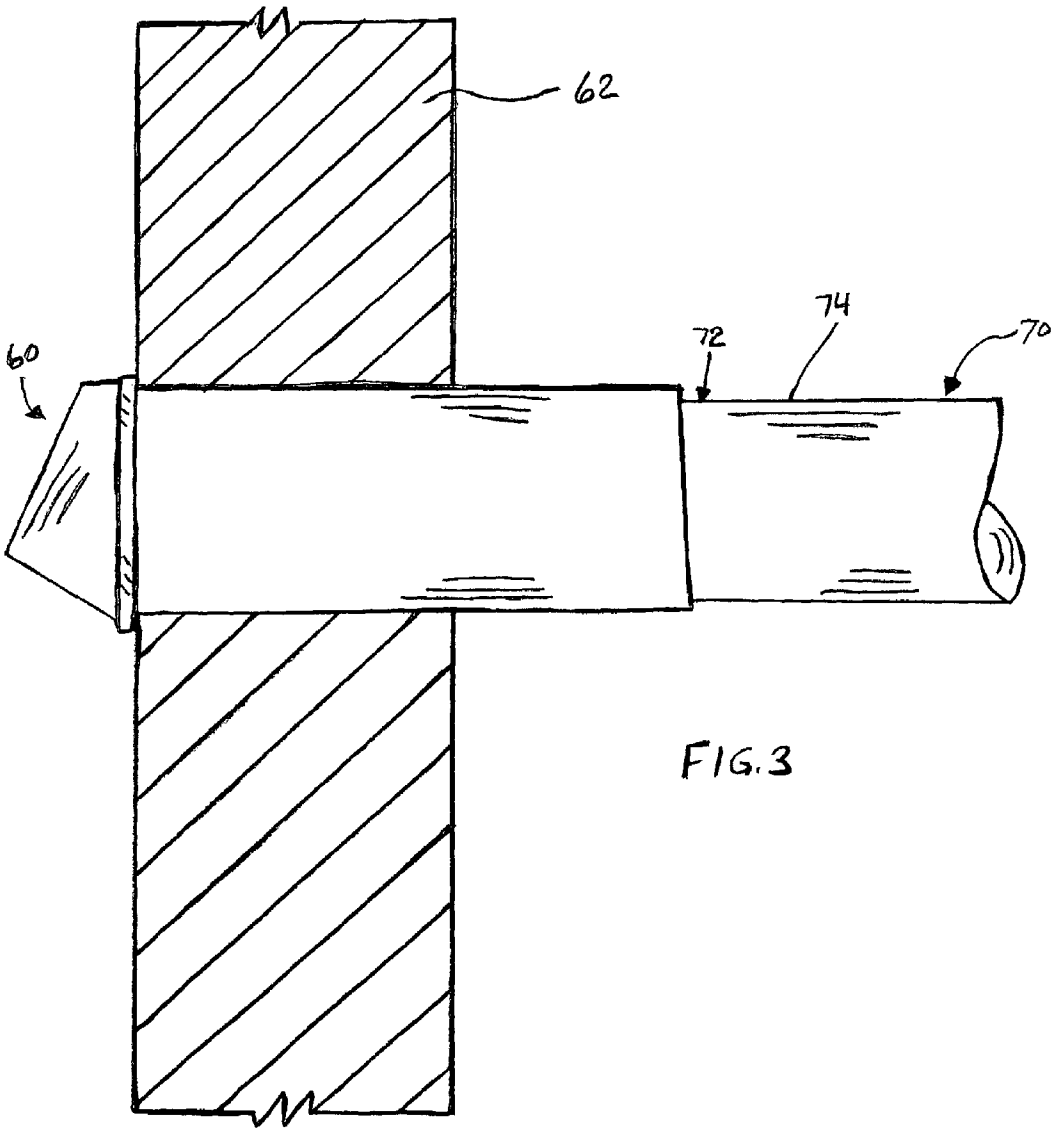
FIG. 3 is a side elevational view showing a typical dryer exhaust vent and associated conduit connected through an exterior wall of a building.
Figure 4:
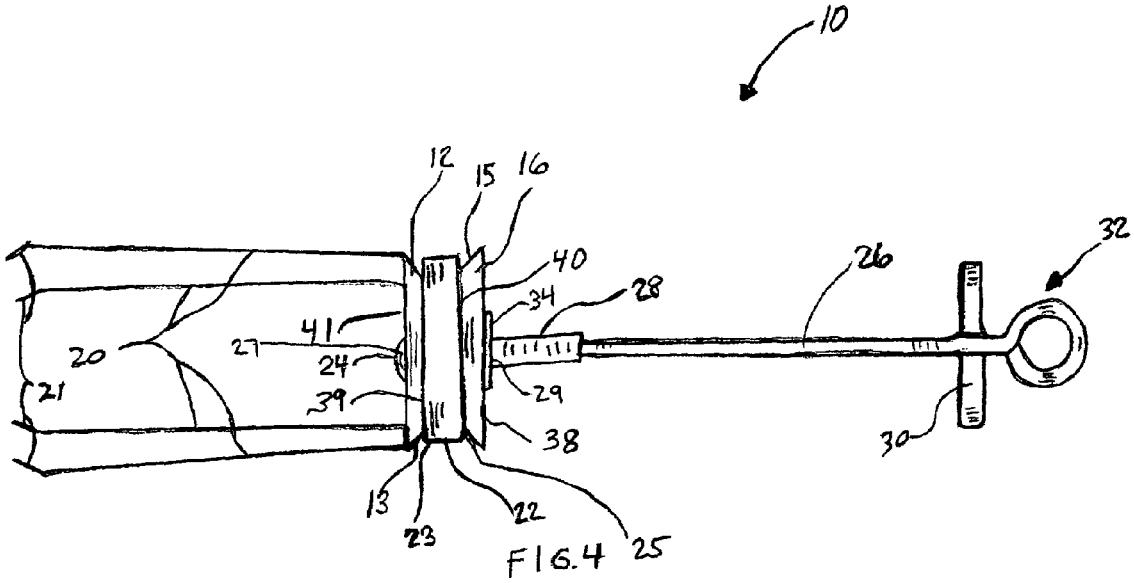
FIG. 4 is a perspective view of a vent connection assembly constructed in accordance with the preferred embodiment of the present invention.
Figure 5:
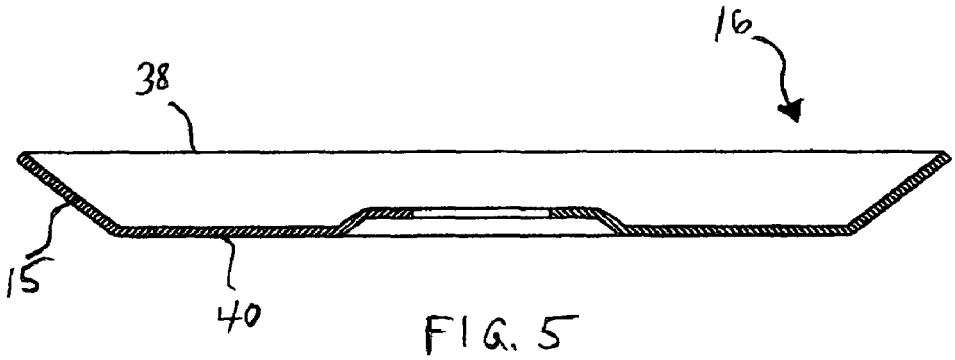
FIG. 5 is a side elevational view showing a second plate of a vent connection assembly constructed in accordance with the preferred embodiment of the present invention.
Figure 6:
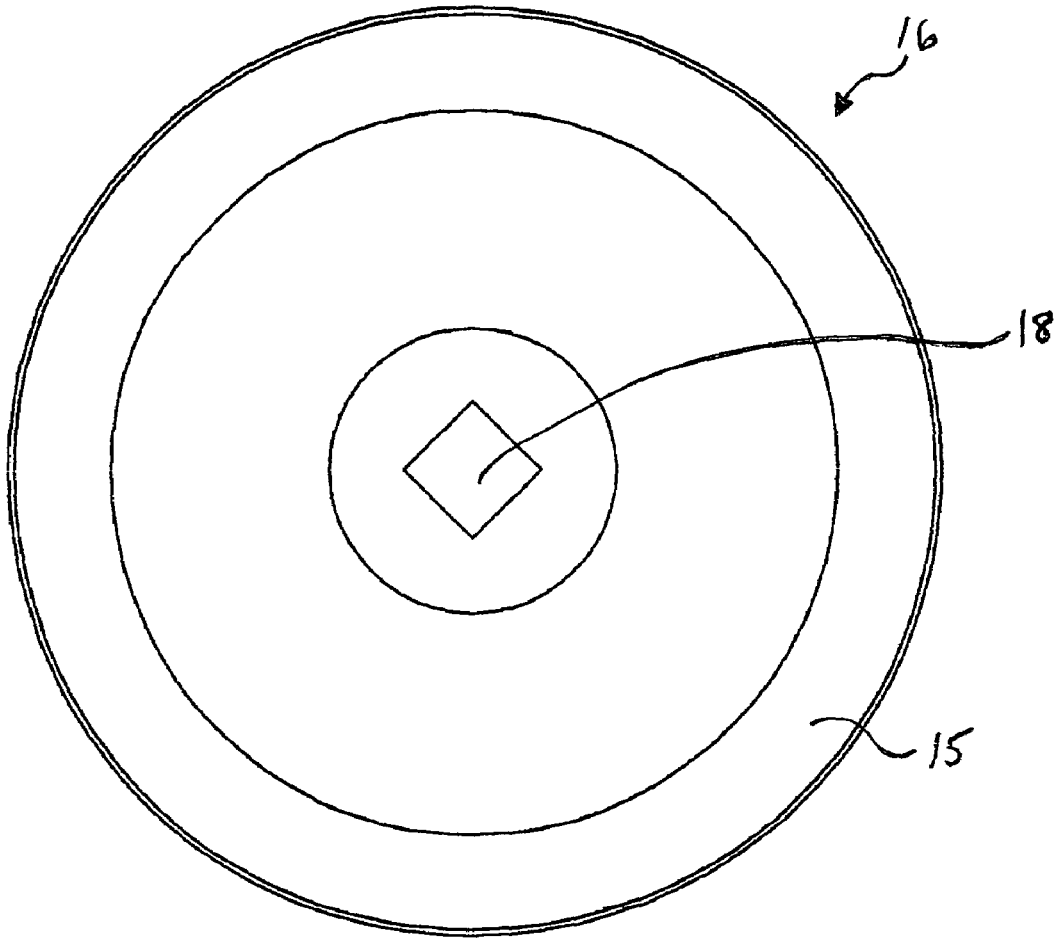
FIG. 6 is a top elevational view showing a second plate of a vent connection assembly constructed in accordance with the preferred embodiment of the present invention.
Figure 7:
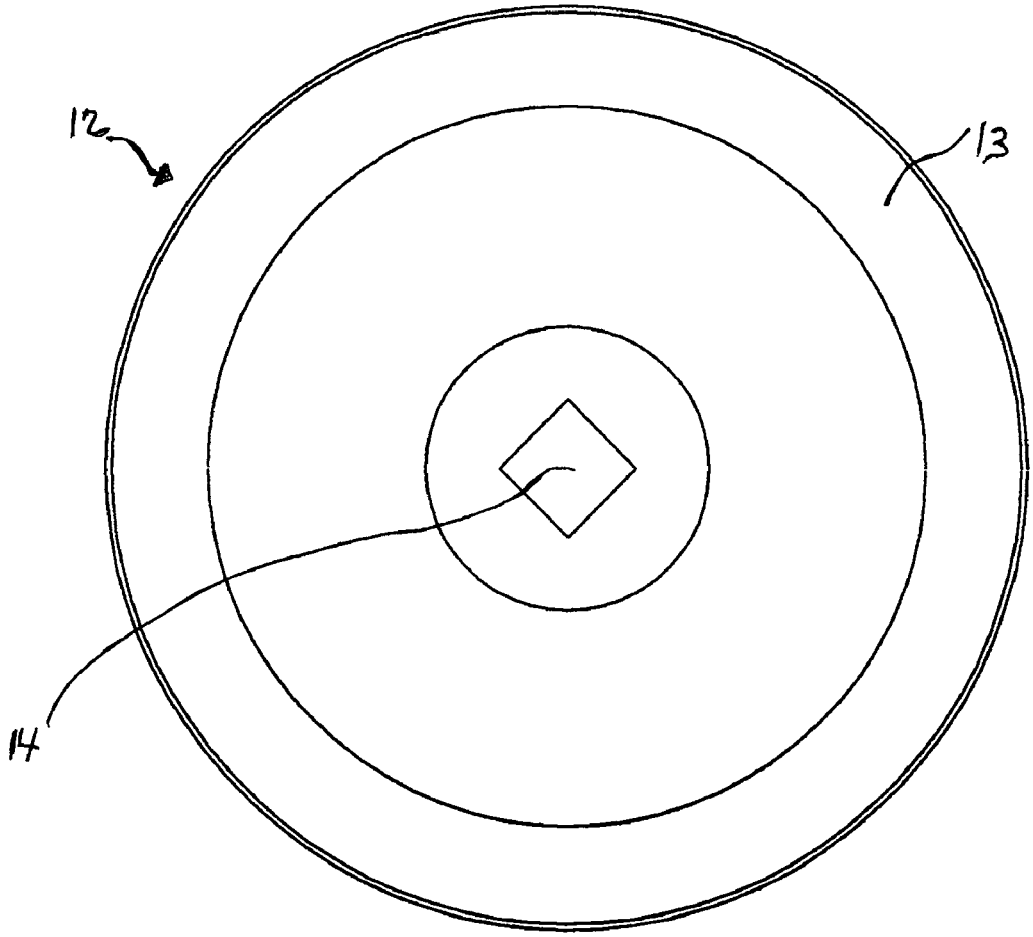
FIG. 7 is a side elevational view showing a first plate of a vent connection assembly constructed in accordance with the preferred embodiment of the present invention.

FIGS. 2 and 3 depict an exemplary conventional dryer exhaust vent 60 which may be connected to a conduit 70. The vent 60 is typically constructed of pliable sheet-metal and comprises an exterior portion 66 and a hollow interior portion 61 having a generally cylindrical smooth internal surface 64. The conduit 70 is also typically constructed of pliable sheet-metal and comprises a hollow end portion 72 having a generally cylindrical smooth external conduit surface 74. The vent 60 is typically sized to have an interior diameter slightly larger than the exterior diameter of the conduit 70, although it should be readily apparent to one skilled in the art that the vent 60 may be sized to have an exterior diameter slightly smaller than the interior diameter of the conduit 70 without departing from the spirit and scope of the present invention.

FIG. 3 depicts a typical horizontal installation of a vent 60 on an exterior wall 62 of a building and interconnection with a conventional conduit 70 in the interior 63 of the building, however the present invention will operate with various installation plans and vents. When positioned, the vent 60 may be interconnected to the conduit 70 within the interior 63 of a building through typical connection means such as caulking, adhesives, banding, friction fit, threading or other conventional connection means.

FIGS. 4-15 depict a vent connection assembly 10 in accordance with the preferred embodiment of the present invention. The function of the vent connection assembly 10 is to facilitate positioning of a vent 60 on the outside 61 of an exterior wall 62 of a building and interconnection of the vent 60 to conduit 70 within the interior 63 of a building.

The vent connection assembly 10 includes a substantially planar, circular first plate 12 defining a centrally disposed first aperture 14 and a substantially planar, circular second plate 16 defining a centrally disposed second aperture 18, as shown in FIGS. 4-7. The plates 12 and 14 of the preferred embodiment of the present invention may contain peripheral flange portions 13 and 15, respectively, which extend generally rearwardly therefrom. The plates 12 and 14 are sized to have a diameter smaller than the diameter of a corresponding vent 60 which is to be positioned using the vent connection assembly 10. For example, the plates 12 and 14 of the preferred embodiment of the present invention may have a 3.5" diameter for use in connection with the installation of a corresponding 4" vent. The plates 12 and 14 are preferably constructed of metal such as aluminum, steel or the like, although it should be readily understood by those skilled in the art that any substantially rigid material will suffice. The plates 12 and 14 are formed by conventional techniques.

The first plate 12 of the preferred embodiment of the present invention includes a plurality of elongated fingers 20 which extend generally rearwardly and perpendicular from the periphery of the first plate 12. The elongated fingers 20 are generally deformed radially outwardly. The elongated fingers 20 have end portions 21 which extend generally radially inwardly therefrom. The elongated fingers 20 may be constructed of ⅛" metal rods, although it should be readily understood by those skilled in the art that any pliable material will suffice. The elongated fingers 20 may be integrally formed with or attached to the first plate 12 by conventional means such as soldering.

The vent connection assembly 10 of the preferred embodiment of the present invention also includes a deformable member 22 defining a centrally disposed third aperture 24. The deformable member 22 is substantially circular. The deformable member 22 of the preferred embodiment is a conventional rubber O-ring having a 3.5" outer diameter. The deformable member 22 is formed by conventional techniques.

The vent connection assembly 10 of the preferred embodiment of the present invention also includes a first threaded bolt 24, a second threaded bolt 26, and a rod coupling 28 having interior threading and being sized to cooperatively engaged the first threaded bolt 24 and second threaded bolt 26. The first threaded bolt 26 may be a ⅜" and 11½" long, black-oxide steel eyebolt. The second threaded bolt 24 may be ⅜" in diameter and 1½" long, having a geometrically shaped neck 44. The neck 44 of the second threaded bolt 24 preferably matches the shape of the first aperture 14 and is sized slightly smaller than the first aperture 14 to allow the neck 44 to be snugly received therein. A handle 30 may be attached proximate the non-threaded end 32 of the first threaded bolt 26. The handle 30 may be ⅜" diameter and 3" long metal rod which may be integrally formed with or attached to the first threaded bolt 26 by conventional means such as soldering.

The vent connection assembly 10 of the preferred embodiment of the present invention optionally includes a conventional washer 34 defining a washer aperture 36.

To assemble the vent connection assembly 10, the rod coupling 28 is threaded onto the first threaded bolt 26. One side 37 of the washer 34 is positioned against the rear 38 of the second plate 16 with the washer aperture 36 cooperatively aligned with the second aperture 18 of the second plate 16. The second side 25 of the deformable member 22 is positioned against the front 40 of the second plate 16 with the third aperture 24 of the deformable member 22 cooperatively aligned with the second aperture 18 of the second plate 16 and the washer aperture 36. The front 39 of the first plate 12 is positioned against the first side 23 of the deformable member 22 with the first aperture 14 of the first plate 12 cooperatively aligned with the third aperture 24 of the deformable member 22, the second aperture 18 of the second plate 16, the washer aperture 36. The second threaded bolt 26 is inserted through the apertures 14, 24, 18 and 36 and threaded onto the rod coupling 28.

Figure 8:
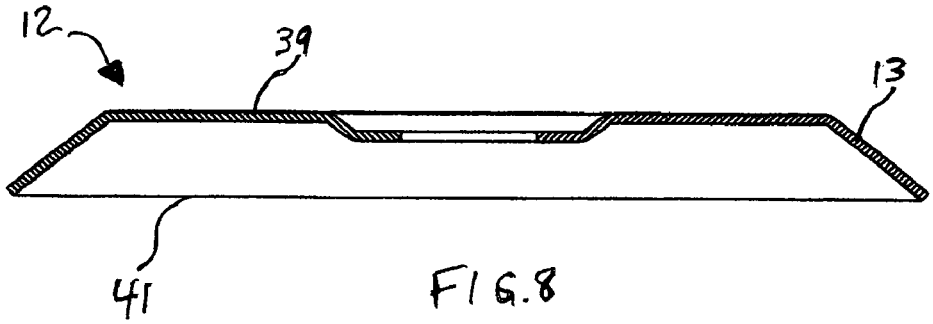
FIG. 8 is a top elevational view showing a first plate of a vent connection assembly constructed in accordance with the preferred embodiment of the present invention.
Figure 9:
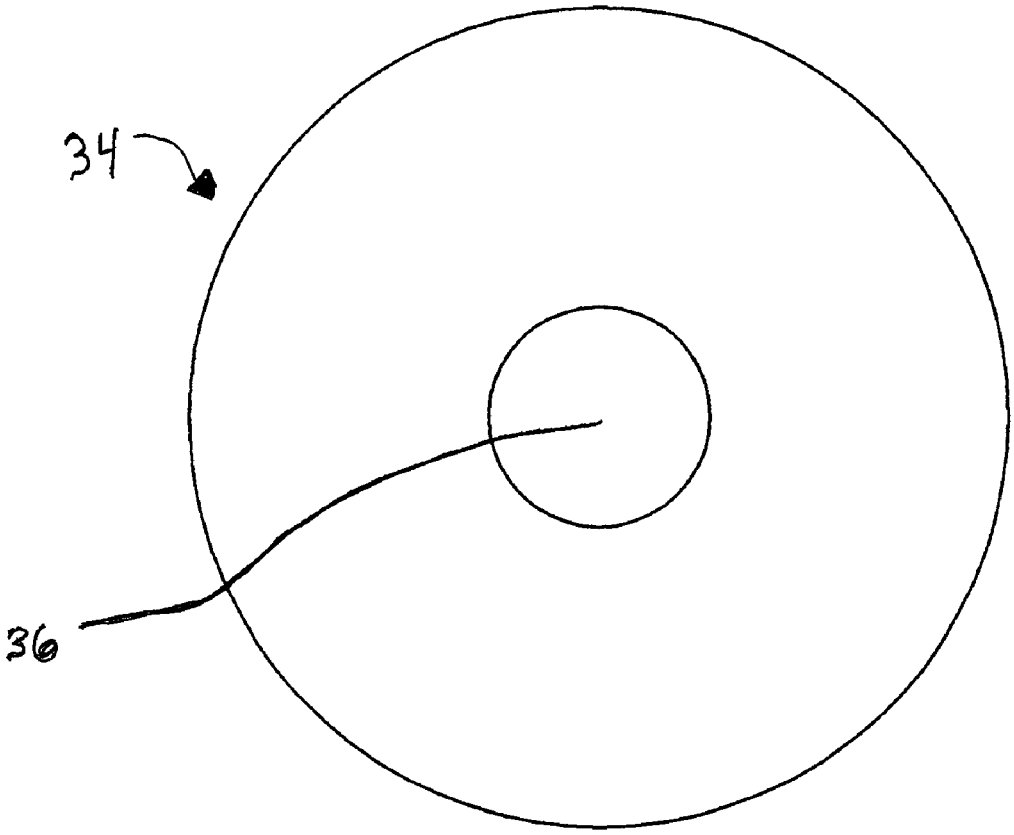
FIG. 9 is a top elevational view showing a washer of a vent connection assembly constructed in accordance with the preferred embodiment of the present invention.
Figure 10:
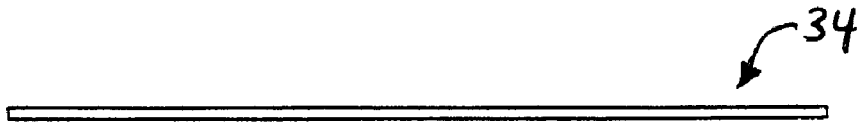
FIG. 10 is a side elevational view showing a washer of a vent connection assembly constructed in accordance with the preferred embodiment of the present invention.
Figure 11:
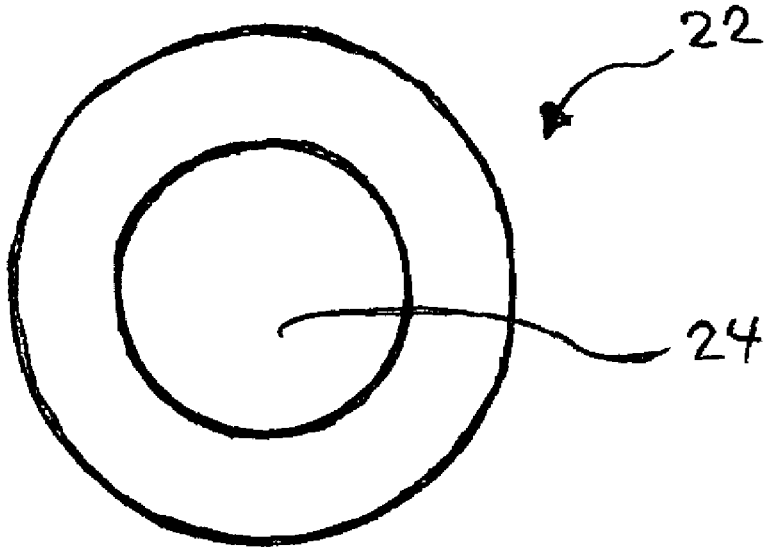
FIG. 11 is a top elevational view showing a deformable member of a vent connection assembly constructed in accordance with the preferred embodiment of the present invention.
Figure 12:
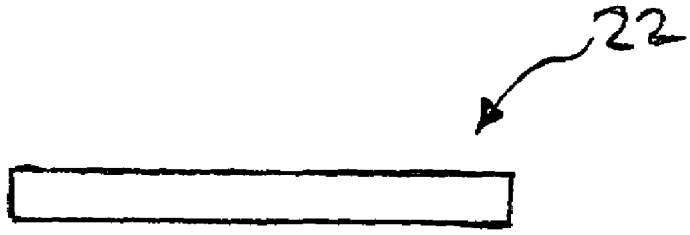
FIG. 12 is a side elevational view showing a deformable member of a vent connection assembly constructed in accordance with the preferred embodiment of the present invention.
Figure 13:
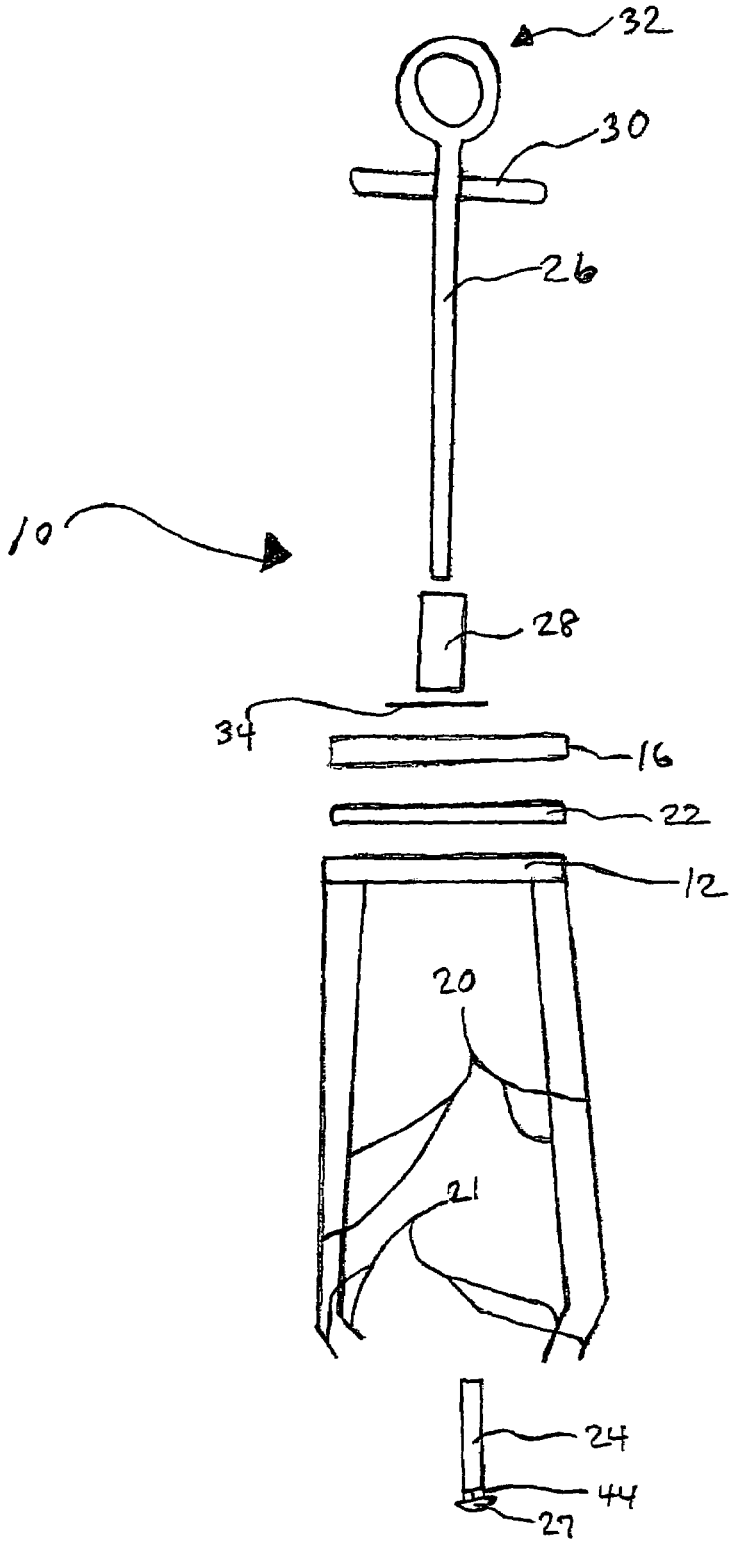
FIG. 13 is an exploded elevational view of the vent connection assembly constructed in accordance with the preferred embodiment of the present invention.

The vent connection assembly 10 according to a preferred embodiment of the present invention is operationally illustrated in FIGS. 8-10 in conjunction with a conventional 4" diameter dryer vent.

FIG. shows an alternative embodiment of the present invention wherein the first plate 12 and second plate 16 of the vent connection assembly 10 constructed comprise discs having diameters which approximate the diameter of the deformable member 22 before deformation of the deformable member 22.

In operation, the second threaded bolt 26 and first threaded bolt 24 are drawn together by rotational translation into the rod coupling 28 until the head 27 of the first threaded bolt 24 engages the rear 41 of the first plate 12 and the distal end 29 of the rod coupling 28 engages the washer 34. It should be readily understood by one skilled in the art that in the absence of the optional washer 34, the distal end 29 of the rod coupling 28 will engage the rear 38 of the second plate 14. The operator may grip and rotate the head of the second threaded bolt 26, the non-threaded end 32 of the first threaded bolt 26 or the handle 30, thereby drawing the second threaded bolt 26 and first threaded bolt 24 together until the head 44 of the second threaded bolt 26 is snugly received in the second aperture 18 of the second plate 16. As the second threaded bolt 26 and first threaded bolt 24 are drawn further together, the pressure exerted by the first plate 12 and second plate 14 onto the deformable member 22 causes the periphery of the deformable member 22 to expand generally radially outwardly.

The operator grips the second threaded bolt 26 and inserts the deformable member 22 of the vent connection assembly 10 into the hollow interior portion 61 of the vent 60. The elongated fingers 20 are biased against the hollow interior portion 61 of the vent 60 to facilitate alignment of deformable member 22 in the hollow interior portion 61 of the vent 60 and to provide support and stability to the vent 60 during translation for installation. The elongated fingers 20 preferably are formed from material having a thickness, hardness, and other properties selected to provide an appropriate amount of resiliency to the elongated fingers 20, as may be readily determined by those of skill in the art. A metal material is suitable, although an appropriate plastic or composite material may be used if desired.

The operator then grips and rotates the head of the second threaded bolt 26, the non-threaded end 32 of the first threaded bolt 26 or the handle 30, thereby further exerting pressure onto the deformable member 22 until the periphery of the deformable member 22 expands to frictionally engage the interior surface 64 of the hollow interior portion 61 of the vent 60. The operator then attaches a rope-like member 76 to the first threaded bolt 26. The rope-like member 76 extends through the opening 65 in the exterior wall 62 and is gripped by an installer. The installer then retracts the rope-like member 76 through the opening 65 in the exterior wall 62 until he or she can grip to the first threaded bolt 26. The installer then draws the vent connection assembly 10 and interior portion of the vent 60 at least partially through the opening 65 in the exterior wall 62 until he or she can grip and rotate the head of the second threaded bolt 26, the non-threaded end 32 of the first threaded bolt 26 or the handle 30, thereby separating the second threaded bolt 26 and first threaded bolt 24 until the periphery of the deformable member 22 contracts to release the interior surface 64 of the hollow interior portion 61 of the vent 60. The rope-like member 76 may be detached from the first threaded bolt 26 when convenient for the installer.

The installer then may interconnect the vent 60 to the conduit 70 within the interior 63 of a building and may install the vent 60 on the exterior wall 62 using conventional means. Caulk or other connection means may be implemented when convenient for the installer.

In operation, the installer and the operator are one person, thereby eliminating the need for multiple persons during installation of the vent 60.

Hence, while the invention has been described in connection with a preferred embodiment and alternative embodiments, it will be understood that it is not intended that the invention be limited to those embodiments. On the contrary, it is intended to cover all alternatives, modifications and equivalents as may be included within the spirit and scope of the invention as disclosed.

As to the manner of usage and operation of the instant invention, same should be apparent from the above disclosure, and accordingly no further discussion relevant to the manner of usage and operation of the instant invention shall be provided.

With respect to the above description then, it is to be realized that the optimum proportions for the elements of the invention, and variations in size, materials, shape, form, function and manner of operation, assembly and use, are deemed readily apparent and obvious to one skilled in the art, and all equivalent relationships described in the specification are intended to be encompassed by the present invention.

Therefore, the foregoing is considered illustrative of only the principles of the invention. Further, since numerous modifications and changes will readily occur to those skilled in the art, it is not desired to limit the invention to the exact method, construction and operation shown and described, and accordingly, all suitable modifications and equivalents may be resorted to, falling within the scope of the invention.

I claim:

1. A vent connection assembly for use in the installation of a vent on an exterior wall of a building and interconnection with a conduit in the interior of the building, comprising:

a first plate having a diameter smaller than the diameter of the vent;

a second plate having a diameter smaller than the diameter of the vent;

a deformable member defining a periphery, said deformable member having a diameter smaller than the diameter of the vent and being positioned between said first plate and said second plate; and a mechanism for drawing said first plate and said second plate together after said deformable member has been inserted into the vent, thereby deforming said deformable member and extending said deformable member radially to frictionally engage the vent, wherein said first plate is substantially planar and defines a first aperture, said second plate is substantially planar and defines a second aperture, said deformable member is substantially circular and defines a third aperture, and said mechanism for drawing said first plate and said second plate together comprises a first threaded bolt, a second threaded bolt, and a rod coupling having interior threading and being sized to cooperatively engage said first threaded bolt and said second threaded bolt.

2. A vent connection assembly for use in the installation of a vent on an exterior wall of a building and interconnection with a conduit in the interior of the building, comprising:

a first plate having a diameter smaller than the diameter of the vent;

a second plate having a diameter smaller than the diameter of the vent;

a deformable member defining a periphery, said deformable member having a diameter smaller than the diameter of the vent and being positioned between said first plate and said second plate; and a mechanism for drawing said first plate and said second plate together after said deformable member has been inserted into the vent, thereby deforming said deformable member and extending said deformable member radially to frictionally engage the vent, wherein a rod coupling is threaded onto a first threaded bolt, said deformable member is positioned between said first plate and said second plate, and a second threaded bolt is inserted through said second aperture, said third aperture, said first aperture and threaded onto the rod coupling.

3. The vent connection assembly of claim 2, wherein said first plate comprises a peripheral flange portion which extends generally rearwardly therefrom and said second plate comprises a peripheral flange portion which extends generally rearwardly therefrom.

4. The vent connection assembly of claim 2, wherein said first plate includes a plurality of elongated fingers which extend generally rearwardly and perpendicular from the periphery of said first plate, said elongated fingers being generally deformed radially outwardly.

5. The vent connection assembly of claim 4, wherein said elongated fingers have end portions which extend generally radially inwardly therefrom.

6. The vent connection assembly of claim 2 further comprising a washer defining a washer aperture, said washer being positioned between said second plate and said rod coupling and said second threaded bolt being inserted through said washer aperture.

7. A vent connection assembly for use in the installation of a vent on an exterior wall of a building and interconnection with a conduit in the interior of the building, comprising:

a first plate having a diameter smaller than the diameter of the vent;

a second plate having a diameter smaller than the diameter of the vent;

a deformable member defining a periphery, said deformable member having a diameter which approximates the diameter of said first plate and of said second plate and being positioned between said first plate and said second plate; and a mechanism for drawing said first plate and said second plate together after said deformable member has been inserted into the vent, thereby deforming said deformable member and extending said deformable member radially to frictionally engage the vent, wherein said first plate is substantially planar and defines a first aperture, said second plate is substantially planar and defines a second aperture, said deformable member is substantially circular and defines a third aperture, and said mechanism for drawing said first plate and said second plate together comprises a first threaded bolt, a second threaded bolt, and a rod coupling having interior threading and being sized to cooperatively engaged said first threaded bolt and said second threaded bolt.

8. A vent connection assembly for use in the installation of a vent on an exterior wall of a building and interconnection with a conduit in the interior of the building, comprising:

a first elate having a diameter smaller than the diameter of the vent;

a second plate having a diameter smaller than the diameter of the vent;

a deformable member defining a periphery, said deformable member having a diameter which approximates the diameter of said first plate and of said second plate and being positioned between said first plate and said second plate; and a mechanism for drawing said first plate and said second plate together after said deformable member has been inserted into the vent, thereby deforming said deformable member and extending said deformable member radially to frictionally engage the vent, wherein a rod coupling is threaded onto a first threaded bolt, said deformable member is positioned between said first plate and said second plate, and a second threaded bolt is inserted through said second aperture, said third aperture, said first aperture and threaded onto the rod coupling.

9. The vent connection assembly of claim 8, wherein said first plate comprises a peripheral flange portion which extends generally rearwardly therefrom and said second plate comprises a peripheral flange portion which extends generally rearwardly therefrom.

10. The vent connection assembly of claim 8, wherein said first plate includes a plurality of elongated fingers which extend generally rearwardly and perpendicular from the periphery of said first plate, said elongated fingers being generally deformed radially outwardly.

11. The vent connection assembly of claim 10, wherein said elongated fingers have end portions which extend generally radially inwardly therefrom.

12. The vent connection assembly of claim 8 further comprising a washer defining a washer aperture, said washer being positioned between said second plate and said rod coupling and said second threaded bolt being inserted through said washer aperture.

13. A method of installing a vent on an exterior wall of a building and connecting the vent to conduit within the interior of a building comprises the following steps:

providing a vent connection assembly having a first plate having a diameter smaller than the diameter of the vent, a second plate having a diameter smaller than the diameter of the vent, a deformable member defining a periphery, said deformable member having a diameter smaller than the diameter of the vent and being positioned between said first plate and said second plate, and a mechanism for drawing said first plate and said second plate together after said deformable member has been inserted into the vent, thereby deforming said deformable member and extending said deformable member radially to frictionally engage the vent;

inserting said deformable member into the vent;

activating said mechanism to draw said first plate and second plate together until pressure exerted by said first elate and said second plate causes the periphery of the deformable member to expand and frictionally engage the vent;

extending a rope-like member through an opening in the exterior wall;

attaching said rope-like member to the vent connection assembly;

retracting the rope-like member through the opening in the exterior wall until the vent connection assembly and an interior portion of the vent extend at least partially through the opening in the exterior wall;

securing the vent connection assembly and interior portion of the vent;

detaching the rope-like member from said vent connection assembly; and interconnecting the vent to conduit within the interior of the building, wherein said first plate is substantially planar and defines a first aperture, said second plate is substantially planar and defines a second aperture, said deformable member is substantially circular and defines a third aperture, and said mechanism for drawing said first plate and said second plate together comprises a first threaded bolt, a second threaded bolt, and a rod coupling having interior threading and being sized to cooperatively engaged said first threaded bolt and said second threaded bolt.

14. The vent connection assembly of claim 13, wherein said first plate includes a plurality of elongated fingers which extend generally rearwardly and perpendicular from the periphery of said first plate, said elongated fingers being generally deformed radially outwardly.

15. The vent connection assembly of claim 14, wherein said elongated fingers have end portions which extend generally radially inwardly therefrom.

16. The vent connection assembly of claim 13 further comprising a washer defining a washer aperture, said washer being positioned between said second plate and said rod coupling and said second threaded bolt being inserted through said washer aperture.

17. A method of installing a vent on an exterior wall of a building and connecting the vent to conduit within the interior of a building comprises the following steps:

providing a vent connection assembly having a first plate having a diameter smaller than the diameter of the vent, a second plate having a diameter smaller than the diameter of the vent, a deformable member defining a periphery, said deformable member having a diameter smaller than the diameter of the vent and being positioned between said first plate and said second plate, and a mechanism for drawing said first plate and said second plate together after said deformable member has been inserted into the vent, thereby deforming said deformable member and extending said deformable member radially to frictionally engage the vent;

inserting said deformable member into the vent;

activating said mechanism to draw said first plate and second plate together until pressure exerted by said first plate and said second plate causes the periphery of the deformable member to expand and frictionally engage the vent;

extending a rope-like member through an opening in the exterior wall;

attaching said rope-like member to the vent connection assembly;

retracting the rope-like member through the opening in the exterior wall until the vent connection assembly and an interior portion of the vent extend at least partially through the opening in the exterior wall;

securing the vent connection assembly and interior portion of the vent;

detaching the rope-like member from said vent connection assembly; and interconnecting the vent to conduit within the interior of the building, wherein a rod coupling is threaded onto a first threaded bolt, said deformable member is positioned between said first plate and said second plate, and a second threaded bolt is inserted through said second aperture, said third aperture, said first aperture and threaded onto the rod coupling.

* * * * *